US005407489A

United States Patent [19]

Hoover

[11] Patent Number: 5,407,489

[45] Date of Patent: Apr. 18, 1995

[54] METHOD FOR CLEANING PICKUP AND FEED ROLLS

[75] Inventor: Stephen R. Hoover, Semmes, Ala.

[73] Assignee: QMS, Inc., Mobile, Ala.

[21] Appl. No.: 131,777

[22] Filed: Oct. 4, 1993

[51] Int. Cl.[6] ..... B08B 7/00

[52] U.S. Cl. ..... 134/6; 134/7; 134/42

[58] Field of Search ..... 134/6, 7, 42

[56] References Cited

U.S. PATENT DOCUMENTS

| | | | |
|---|---|---|---|
| 2,104,060 | 1/1938 | Spafford | 154/55 |
| 2,394,855 | 2/1946 | Gould | 197/184 |
| 2,796,367 | 6/1957 | Brown | 134/6 |
| 3,477,084 | 11/1969 | Thomas | 15/104.93 |
| 3,485,349 | 12/1969 | Chaney, Jr. | 206/56 |
| 4,611,361 | 9/1986 | Shinkai | 15/104.93 |
| 4,686,132 | 8/1987 | Sumii et al. | 428/171 |
| 4,760,618 | 8/1988 | Chapin, Jr. | 15/104.93 |
| 4,891,265 | 1/1990 | Samagalsky | 15/104.43 |
| 4,953,252 | 9/1990 | Akisawa | 15/308 |
| 5,230,744 | 7/1993 | Smith et al. | 134/6 |

OTHER PUBLICATIONS

LaserKleen TM Paper Cleaner by Masterpiece TM, Mar. 10, 1993.

*Primary Examiner*—Melvyn J. Andrews
*Assistant Examiner*—Zeinab El-Arini
*Attorney, Agent, or Firm*—Webb Ziesenheim Bruening Logsdon Orkin & Hanson

[57] ABSTRACT

A method and apparatus for cleaning pickup and feed rolls of machines such as printers, copiers, facsimile machines and the like. The method utilizes a roll cleaner which includes an absorbent layer and cleaning solution provided within the absorbent layer. The roll cleaner is sufficiently thick to prevent the roll cleaner from feeding through the machine. The pickup and feed rolls will spin against the absorbent layer for cleaning. The roll cleaner may be stored in a resealable cellophane bag.

5 Claims, 1 Drawing Sheet

FIG. 1
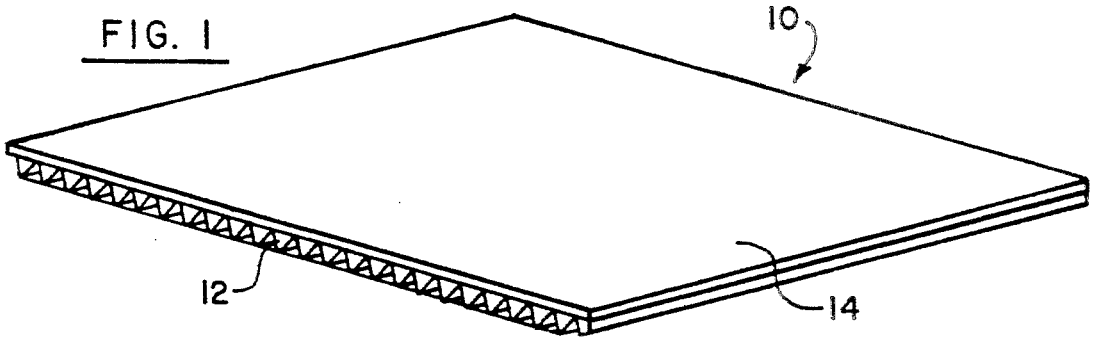
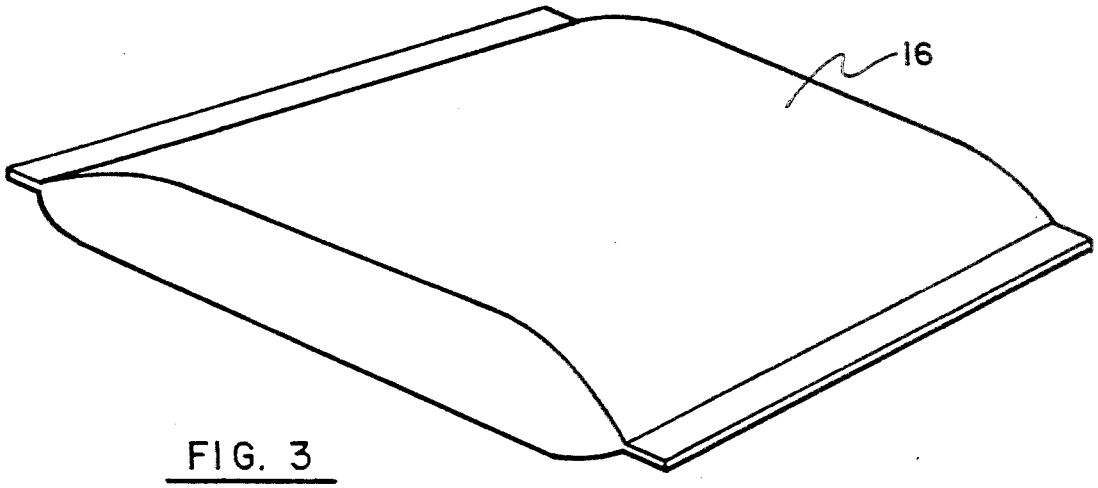
FIG. 3
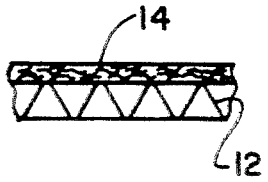
FIG. 2
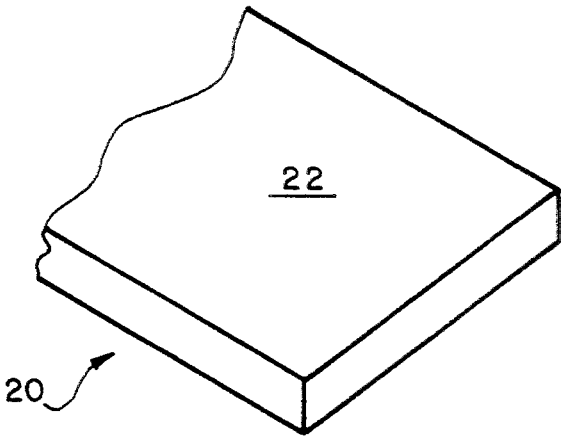
FIG. 4

METHOD FOR CLEANING PICKUP AND FEED ROLLS

BACKGROUND OF THE INVENTION

1. Field of the Invention

The present invention relates to a cleaning apparatus and method for cleaning the pickup and feed rolls of machines such as printers, copiers, facsimile machines and the like.

2. Prior Art

Through continued use, the pickup and feed rolls of printers, copy machines, facsimile machines and the like will become soiled and will require cleaning. If the cleaning is not done, the machine will often misfeed or jam, requiring more extensive servicing. In general, the current method of cleaning pickup and feed rolls is by hand, utilizing a rag and cleaning solution. This manual method has the disadvantage of requiring a certain amount of disassembly of the specific machine, as well as requiring the user to handle cleaning solutions.

Several attempts have been made to design a roll cleaner to automatically clean the pickup and feed rolls of such machines. For example, U.S. Pat. No. 4,611,361 to Shinkai discloses a sheet for cleaning the surface of paper conveying rolls. The cleaning is performed by inserting the sheet into the facsimile apparatus. The sheet is divided into two halves which are conveyed through the conveying rolls. The front half of the sheet is impregnated with cleaning fluid and has sufficient compressibility so that when the impregnated sheet is clasped between the conveying rolls, the cleaning fluid is squeezed out onto the rolls. The rear half of the sheet is an absorbing sheet which absorbs the cleaning fluid which adheres to the surface of the rolls.

Similar to the Shinkai patent, U.S. Pat. No. 4,891,265 to Samagalsky discloses a prepackaged sheet for cleaning the rolls of a facsimile machine. The absorbent sheet is of a suitable size and weight for passing through the facsimile machine and is impregnated with a cleaning fluid, for example isopropyl alcohol.

Both the Shinkai and the Samagalsky patents are specifically designed to feed through the machine being cleaned. This has the disadvantage of not necessarily providing a spinning action or relative movement between the roll being cleaned and the cleaning surface, resulting in ineffective cleaning. Additionally, the feeding of the cleaning sheet through the machine increases the likelihood of jamming of the machine by the cleaning sheet.

The object of the present invention is to overcome the aforementioned drawbacks of the prior art. A further object of the present invention is to provide an efficient and cost-effective roll cleaning method and apparatus for cleaning the pickup and feed rolls of machines such as printers, copiers, facsimile machines and the like.

SUMMARY OF THE INVENTION

The present invention provides a cleaner for cleaning pickup and feed rolls of printers, copiers, facsimile machines and the like. The roll cleaner includes an absorbent layer and cleaning solution impregnated in the absorbent layer. The roll cleaner has a thickness sufficient to prevent the roll cleaner from being fed through the machine, the rolls of which are being cleaned.

A first embodiment of the roll cleaner includes a base member with an absorbent layer attached to the base member and cleaning solution impregnated in the absorbent layer. The base member is sufficiently thick to prevent the roll cleaner from being fed through the machine being cleaned.

In the first embodiment of the present invention, the base member is in the form of a rigid stiffener board which may be formed of corrugated plastic. The rigid stiffener board may be at least 0.040" thick to effectively prevent feeding through the machine being cleaned. The base member and the absorbent layer of the present invention may be formed to have a length and width conforming to conventional paper size such as, for example, $8\frac{1}{2}'' \times 11''$ so as to fit easily within typical paper-holding trays for use. Additionally, a resealable cellophane bag can be utilized to enclose the roll cleaner before and after use.

A second embodiment of the roll cleaner provides an absorbent layer sufficiently thick to prevent the roll cleaner from being fed through the machine being cleaned. In the second embodiment, the absorbent layer may have a thickness of at least 0.25". The absorbent layer of the second embodiment may also be formed of standard paper dimension, such as $8\frac{1}{2}'' \times 11''$.

In operation, the roll cleaner of the present invention is placed adjacent the pickup and feed rolls of the machine to be cleaned. Subsequently, the pickup and feed rolls are caused to rotate, wherein the pickup and feed rolls slidably contact the absorbent layer. The spinning of the pickup and feed rolls against the absorbent layer and the impregnated cleaning solution will effectively clean the pickup and feed rolls.

These and other objects of the present invention will be clarified in the description of the preferred embodiments in connection with the accompanying drawings.

BRIEF DESCRIPTION OF THE DRAWINGS

FIG. 1 is a perspective view of a roll cleaner according to a first embodiment of the present invention;

FIG. 2 is an enlarged side view of a portion of the roll cleaner illustrated in FIG. 1;

FIG. 3 is a perspective view of a resealable cellophane bag for enclosing a roll cleaner according to the present invention; and FIG. 4 is a perspective view of a portion of a roll cleaner according to a second embodiment of the present invention.

DESCRIPTION OF THE PREFERRED EMBODIMENTS

FIGS. 1 and 2 illustrate a roll cleaner 10 according to the present invention. The roll cleaner 10 includes a plastic stiffener forming a rigid base member 12. The base member 12 can also be effectively formed of stiff chipboard or other conventional material.

An absorbent layer 14 is attached to the top surface of the base member 12 in a conventional fashion, such as by use of an adhesive. The absorbent layer 14 can be, for example, made of nylon or TYVEK® material, produced by E. I. Du Pont De Nemours & Co. Inc. The absorbent layer 14 is treated, or impregnated, with a roll cleaning solution. The roll cleaning solution may be a solvent such as FEDRON™, produced by Federal Mining & Manufacturing Co., trichloroethane xylene, alcohol or the like.

The base member 12 and the absorbent layer 14 have a total thickness sufficient to prevent the roll cleaner 10 from being fed through a machine which is being cleaned. The base member 12 should have a thickness of at least 0.040" to independently prevent the roll cleaner 10 from being fed through a machine which is being cleaned. The base member 12 may be effectively made as a corrugated plastic stiffener sheet which is substantially 0.040" in thickness.

The roll cleaner has a length and width dimension of the base member 12 and the absorbent layer 14 which conforms to a conventional paper size such as, for example, $8\frac{1}{2}'' \times 11''$. This configuration will permit the roll cleaner 10 to be easily placed within a paper roll tray.

FIG. 3 illustrates a resealable cellophane bag 16. The resealable cellophane bag 16 will enclose the roll cleaner 10 and maintain the cleaning solution moist within the absorbent layer 14.

In operation, the roll cleaner 10 is removed from the cellophane bag 16 and placed in a paper-holding tray of the machine to be cleaned such that the roll cleaner 10 is adjacent the pickup and feed rolls of the machine to be cleaned. Subsequently, the pickup and feed rolls are caused to be rotated such that they slidably contact the absorbent layer 14. The spinning of the pickup and feed rolls against the absorbent layer 14 will cause effective cleaning of the pickup and feed rolls. Spinning of the pickup and feed rolls can be started by pressing an auto test button found on the machine.

After the pickup and feed rolls have been cleaned, the roll cleaner 10 can be repackaged within the cellophane bag 16 for later use, wherein the process is repeated.

Shown in FIG. 4 is a second embodiment of a roll cleaner 20 according to the present invention. The roll cleaner 20 eliminates the base member by forming an absorbent layer 22 which is sufficiently thick to prevent the roll cleaner 20 from being fed through the machine being cleaned. The absorbent layer 22 should be at least 0.25" thick. The absorbent layer 22 is impregnated with an appropriate roll cleaning solution. The roll cleaner 20 may be packaged within the resealable cellophane bag 16 and dimensioned to fit within a conventional paper tray. The roll cleaner 20 operates in the same manner as roll cleaner 10 described above.

Although specific embodiments of the present invention have been disclosed herein, various modifications may be made to the present invention without departing from the spirit and scope thereof. The scope of the present invention is intended to be defined by the appended claims.

I claim:

1. A method of cleaning pickup and feed rolls on machines including printers, copiers and facsimile machines, said roll cleaning method comprising the steps of:

a) placing a roll cleaner adjacent the pickup and feed rolls of a machine, wherein said roll cleaner has a thickness sufficient for preventing said roll cleaner from being fed through the machine of which the rolls are being cleaned, and said roll cleaner includes an absorbent layer which is attached to a rigid stiffener board having a thickness of at least 0.040" and a cleaning solution provided within said absorbent layer; and b) rotating said pickup and feed rolls wherein said pickup and feed rolls slidably contact said absorbent layer which is prevented from being fed through the machine.

2. The method of claim 1 wherein said placing step includes placing said roll cleaner in a paper-holding tray.

3. The method of claim 1 further including the step of removing said roll cleaner from a resealable cellophane bag prior to said placing step.

4. The method of claim 3 further including the step of replacing said roll cleaner within said resealable cellophane bag following said rotating step.

5. A method of cleaning pickup and feed rolls on machines including printers, copiers and facsimile machines, said roll cleaning method comprising the steps of:

a) placing a roll cleaner in a paper-holding tray adjacent the pickup and feed rolls of a machine, wherein said roll cleaner has a thickness sufficient for preventing said roll cleaner from being fed through the machine of which the rolls are being cleaned, and said roll cleaner includes an absorbent layer attached to a rigid stiffener board and a cleaning solution provided within said absorbent layer, wherein said rigid stiffener board has a length and width conforming to a conventional paper size; and b) rotating said pickup and feed rolls wherein said pickup and feed rolls slidably contact said absorbent layer which is prevented from being fed through the machine.

* * * * *